United States Patent [19]

Yasui et al.

[11] Patent Number: 4,844,002

[45] Date of Patent: Jul. 4, 1989

[54] COATING FEEDER SYSTEM

[75] Inventors: Yoshinari Yasui; Takashi Iwasaki, both of Ebina, Japan

[73] Assignee: Yasui Seiki Co., Ltd., Tokyo, Japan

[21] Appl. No.: 112,693

[22] Filed: Oct. 26, 1987

[30] Foreign Application Priority Data

| | | | |
|---|---|---|---|
| Apr. 16, 1987 | [JP] | Japan | 62-57886[U] |
| Apr. 16, 1987 | [JP] | Japan | 62-57887[U] |
| Apr. 16, 1987 | [JP] | Japan | 62-57888[U] |

[51] Int. Cl.[4] ..... B05C 1/08

[52] U.S. Cl. ..... 118/259; 118/612; 118/261; 118/212; 101/153

[58] Field of Search ..... 101/153; 118/612, 259, 118/212, 261

[56] References Cited

U.S. PATENT DOCUMENTS

| | | | |
|---|---|---|---|
| 1,793,082 | 2/1931 | Goss | 118/212 |
| 2,641,219 | 6/1953 | Tranter | 118/244 X |
| 3,094,924 | 6/1963 | Stark | 118/259 X |
| 3,177,847 | 4/1965 | Schnierlein | 118/407 |
| 3,498,262 | 3/1970 | Hill et al. | 118/259 X |
| 3,540,410 | 11/1970 | Osborne, Jr. et al. | 118/259 X |
| 4,128,077 | 12/1978 | Meier | 118/104 |

FOREIGN PATENT DOCUMENTS

| | | |
|---|---|---|
| 2237556 | 8/1971 | Fed. Rep. of Germany . |
| 2526390 | 5/1976 | Fed. Rep. of Germany . |
| 7723027 | 1/1977 | France . |
| 2503373 | 4/1973 | Japan . |
| 4903778 | 5/1978 | Japan . |
| 4194579 | 4/1979 | Japan . |
| 4581283 | 10/1983 | Japan . |
| 22345983 | 12/1983 | Japan . |
| 1017640 | 1/1966 | United Kingdom . |
| 1804370 | 1/1972 | United Kingdom . |
| 1349173 | 3/1974 | United Kingdom . |

OTHER PUBLICATIONS

Handbook on Gravure Printing, Publication Date Jul. 25, 1981, Editor: Masayoshi Araki, Publisher: Kakou Gijutsu Kenkyujs, Title pp. 463, 464, Abstract Page and English Translation of p. 463.

*Primary Examiner*—Shrive Beck
*Assistant Examiner*—Alain Bashore
*Attorney, Agent, or Firm*—Charles N. Quinn

[57] ABSTRACT

A coating feeder system is disclosed herein. The coating feeder system comprises, in close vicinity to an outer peripheral surface of a gravure roll, a coating container or vessel defining a reservoir for storing a coating under a pressurized condition and a stirring mechanism for stirring the coating within the reservoir. The stirring mechanism may be a stirring and feeding roll mounted within said reservoir. The stirring and feeding roll includes forcedly stirring means formed on an outer peripheral surface thereof for forcedly stirring the coating.

8 Claims, 7 Drawing Sheets

COATING FEEDER SYSTEM

FIELD OF THE INVENTION

The present invention relates to a coating feeder system for feeding a coating to a gravure roll.

BACKGROUND OF THE INVENTION

In general, in a gravure coater, a coating is supplied to an engraved portion of a gravure roll, and the coating deposited in the engraved portion is applied to a web. In order to provide a high grade of such an application finish, the coating must be supplied uniformly to the engraved portion of the gravure roll.

To this end, it is a conventional practice to immerse only a lower portion of an ink roll into a coating stored in an upwardly opened pad without direct immersion of the gravure roll into the coating, and rotate the ink roll to take up the coating while depositing it onto the ink roll, thereby supplying the coating to the gravure roll in contact with the ink roll, for example, as described in Japanese Utility Model Publication Nos. 19601/77 and 38276/82.

In the prior art, however, a coating classified into a Newtonian fluid having a small viscosity is uniformly supplied to the gravure roll, but a magnetic coating or the like which presents a gel in a normal condition could not be uniformly supplied to the gravure roll. This results in a failure to apply the coating with a uniform thickness to the web, providing a degraded application finish. Some of the coatings in the form of a mixture of a plurality of components, such as those containing easily precipitatable components and those comprising components easily separatable from each other, should be applied to the web in such a condition that the individual components have been uniformly mixed together. In the prior art, it has been difficult to supply such coatings to the gravure roll in a condition of the individual components uniformly mixed together.

Thereupon, a lower end of an outer peripheral surface of the gravure roll has conventionally been immersed into the coating within the pad, so that the coating may be supplied to the gravure roll while being permitted to overflow in a large amount out of the pad to the outside.

However, the prior art is accompanied by disadvantages that there is a wasteful coating and that when the overflowed coating is to be reused, a volatile component or components can scatter from the coating at overflowing, resulting in a very troublesome adjustment of the viscosity of the coating in the pad.

In addition, a pump has been placed for feeding the coating into the pad, apart from the pad portion. When the coating to be gravure-applied is changed, however, the specially placed pump of a complicated structure must be also thoroughly cleaned, resulting in a failure to rapidly conduct, for example, a color overchange or the like.

BRIEF SUMMARY OF THE INVENTION

The present invention has been accomplished with the foregoing in view, and it is an object of the present invention to provide a coating feeder system which enables all types of coatings to be uniformly supplied to a gravure roll and still, is simple in construction, and in which a wastefulness of the coating can be eliminated and a high grade of an application finish can be provided.

It is another object of the present invention to provide a coating feeder system which also has a pumping function and is simple in both of construction and cleaning.

It is a further object of the present invention to provide a coating feeder system which enables all types of coatings to be uniformly supplied to a gravure coater capable of providing a normally good application even to a thin web without generation of vertical wrinkles and also providing a multi-color coating application satisfactorily and still, is simple in construction, and in which a wastefulness of the coating can be eliminated and a high grade of an application finish can be provided.

To accomplish the above objects, according to the present invention, there is provided a coating feeder system comprising, in close vicinity to an outer peripheral surface of a gravure roll, a coating container or vessel defining a reservoir for storing a coating under a pressurized condition and a stirring mechanism for stirring the coating within a reservoir. This enables all types of coatings to be uniformly supplied to the gravure roll and still, the coating feeder system is simple in construction, while ensuring an effect that a wastefulness of the coating can be eliminated and a high grade of a coating finish can be provided.

In addition, to achieve the above objects, there is provided a coating feeder system comprising, in close vicinity to an outer peripheral surface of a gravure roll, a coating container or vessel defining a reservoir for storing a coating under a pressurized condition, a stirring and feeding roll rotatably mounted within the reservoir for stirring the coating within the reservoir, a coating feed passage which permits feeding of the coating through a central axial hole and a large number of radial holes in the stirring and feeding roll into the reservoir, and a pumping mechanism.

Further, to accomplish the above objects, according to the present invention, there is provided a coating feeder system comprising, in close vicinity to an outer peripheral surface of a gravure roll adapted to provide the application of a coating on a lower surface of a continuous travelling web at a place in which an upper surface of the web is free, a coating container or vessel defining a reservoir for storing a coating under a pressurized condition and a stirring mechanism for stirring the coating within the reservoir.

DETAILED DESCRIPTION OF THE EMBODIMENTS

The present invention will now be described by way of preferred embodiments illustrated in the accompanying drawings.

Figure 1:
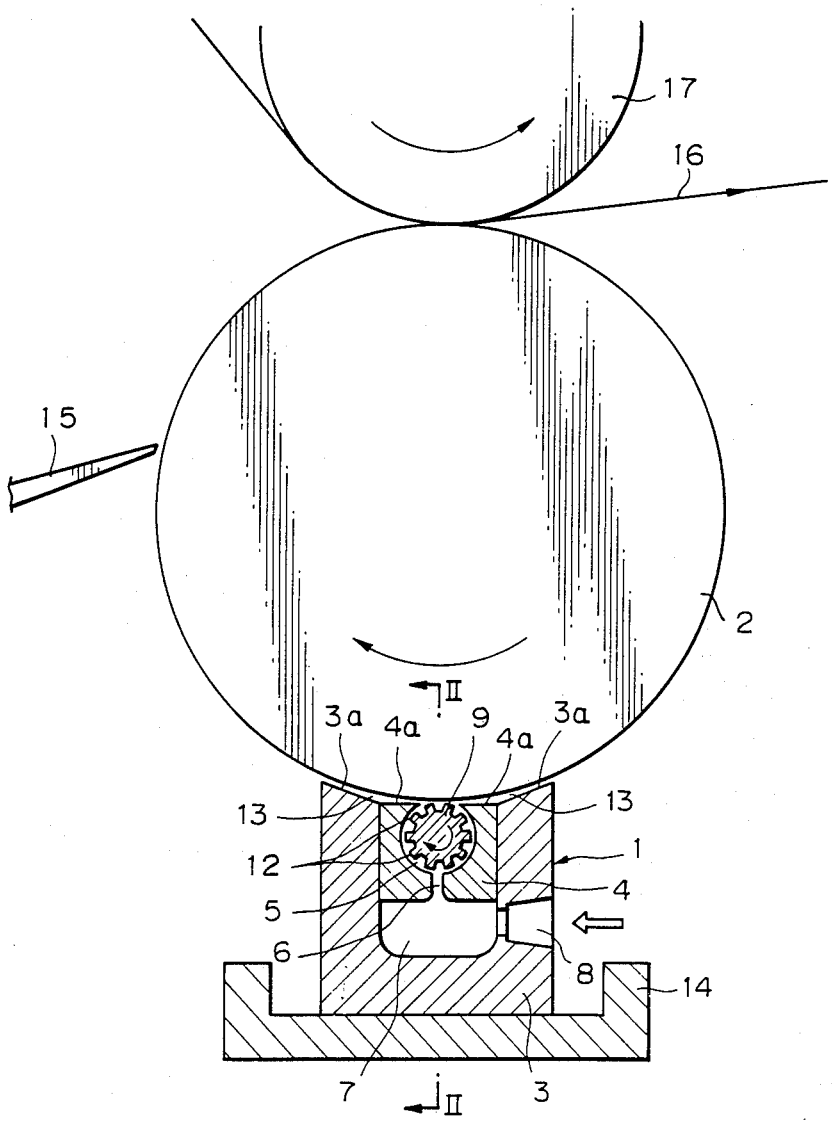
FIG. 1 is a front view in vertical section of a coating feeder system according to one embodiment of the present invention.
Figure 2:
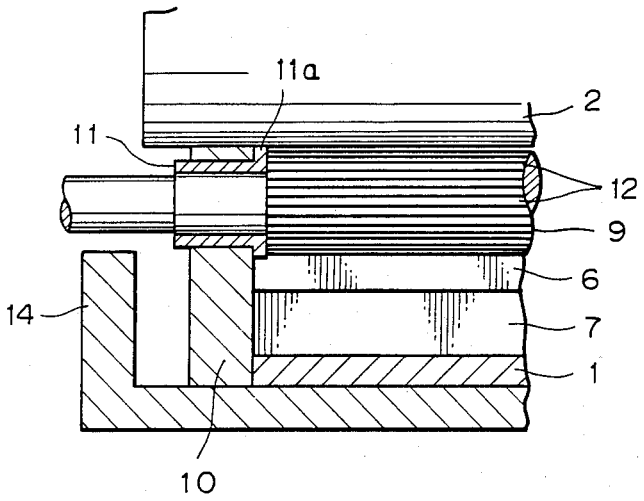
FIG. 2 is a sectional view taken along a line II—II in FIG. 1.

FIGS. 1 and 2 illustrates one embodiment of the present invention.

In these Figures, the reference character 1 designates a coating vessel or container which is mounted below a gravure roll 2. The vessel 1 is comprised of a first body 3 having a substantially U-shaped section, and a second body 4 secured in a recess of the first body 3 at the upper portion thereof. The second body 4 includes a reservoir 5 of a substantially circular section, which is defined between the second body 4 and the lower end of an outer peripheral surface of the gravure roll 2 for storing a coating under a pressurized condition. The second body 4 further includes an antechamber 7 defined between the second body 4 and the first body 3 to communicate with the reservoir 5 through a narrow passage 6. A coating is fed into the antechamber 7 through a feed hole 8 perforated in the first body 3 at its lower portion. A stirring and feeding roll 9, which may be one type of a stirring mechanism for stirring a coating in a pressurized condition, is rotatably suspended transversely within the reservoir 5. More specifically, the stirring and feeding roll 9 is shown at only one end thereof in FIG. 2, and is rotatably supported at its opposite ends on closing walls 10 with solid sleeve bearings 11 interposed therebetween. Further, the one end of the roll 9 is passed through the closing wall 10 in a liquid tight manner to extend outwardly of the reservoir 5 and connected to suitable drive means. The stirring and feeding roll 9 is positioned with the upper portion (the uppermost end in the present embodiment) of the outer peripheral surface thereof being close to the lower portion (the lowermost end in the present invention) of the outer peripheral surface of the gravure roll 2, so that the coating may be forcedly supplied to an engraved portion 2*a* formed on the gravure roll 2. The stirring and feeding roll 9, when rotated, stirs the coating stored in the reservoir 5 under a pressurized condition, and depending upon the natures of the coatings, the outer peripheral surface of the stirring and feeding roll 9 may be flat, or may be formed with forcedly stirring means 12 shaped into a serration as in the present embodiment, if they are capable of stirring the coating. The forcedly stirring means 12 may be formed by forming the outer peripheral surface of the stirring and feeding roll 9 into a rugged shaped, depending the natures of the coatings. An effective rugged shape may be selected, for example, from the above serration, a gear shape, a threaded shape having small pitches and the like. In this embodiment, a slight gap is provided between the outer peripheral surfaces of the gravure roll 2 and the stirring and feeding roll 9, so that the gravure roll 2 may be smoothly rotated, and a coating may be reliably and uniformly supplied to the engraved portion of the gravure roll 2. The slight gap is adjusted by bringing flanges 11*a* of the solid sleeve bearings 11 exposed from the outer peripheral surface of the stirring and feeding roll 9 over the same length as the slight gap into sliding contact with the outer peripheral surface of the gravure roll 2. In this embodiment, each of upper surfaces 3*a* of the first body 3 is inverted / \-shaped toward the gravure roll 2, and each of upper surfaces 4*a* of the second body 4 is horizontal. A slight gap is provided between each of the upper surfaces 3*a* and 4*a* and the outer peripheral surface of the gravure roll 2, so that the latter may be smoothly rotated. In addition, a very small pressure chamber 13 is defined by cooperation of the upper surfaces 3*a* and 4*a* with the outer peripheral surface of the gravure roll 2 for permitting the repressurization of the coating to achieve the uniform and reliable application of the coating onto the outer peripheral surface of the gravure roll 2. It should be noted that the coating vessel or container 1 is mounted within an overflow receptacle 14 for receiving an overflowed coating and is vertically movable together with the overflow receptacle 14 into and out of contact with the gravure roll 2.

Description will now be made of the operation of this embodiment.

In this embodiment, the stirring and feeding roll 9 has a diameter approximately one tenth of that of the gravure roll 2, i.e., as small as about 20 mm. In applying a coating, the stirring and feeding roll 9 is relatively rapidly rotated in the same direction and at substantially the same circumferential speed as the gravure roll 2. A coating which exhibits a gel form under a normal condition, such as a magnetic coating, is pumped by a pump or the like through the feed hole 8, the antechamber 7 and the narrow passage 6 into the reservoir 5 of the coating container 1 in which the stirring and feeding roll 9 is being rotated. Then, the coating is stored under a pressurized condition in the reservoir 5 and thereby spreaded uniformly throughout the reservoir 5, so that it may be applied onto the gravure roll 2 in an axially uniform manner. In this case, the coating stored under the pressurized condition in the reservoir 5 is stirred by the rapid rotation of the stirring and feeding roll 9. Particularly, because the forcedly stirring means 12 shaped in the serration is provided on the outer periphery of the stirring and feeding roll 9 in the present embodiment, the coating within the reservoir 5 is reliably stirred. Because this coating has a thixotropic nature that is transformed from a gel to a fluid sol when stirred, it is converted into an applyable form to be deposited on the gravure roll 2, as is the case with a coating having an increased fluidity and classified into a Newtonian fluid. The coating converted into the applyable form in this way is forcedly and uniformly supplied into the engraved portion of the gravure roll 2 upon reception of a pressing force due to its own pressurized condition and by a component of rotational force of the stirring and feeding roll 9. Then, the coating applied uniformly on the outer peripheral surface of the gravure roll 2 is carried from the reservoir 5 toward a doctor blade 15 as the gravure roll 2 is rotated.

In the present embodiment, since the very small pressure chamber 13 is further defined downstream from the reservoir 5 in the rotational direction of the gravure roll 2, the coating carried out of the reservoir 5 is once kept in residence under a pressurized condition within the very small pressure chamber 13. The coating is thereby deposited further axially uniformly on the gravure roll 2, and it is then carried out of the very small pressure chamber 13 toward the doctor blade 15 as the gravure roll 2 is rotated.

Subsequently, the coating uniformly deposited on the outer peripheral surface of the gravure roll 2 is carried upwardly with the rotation of the gravure roll 2 and then scraped down in an excessive amount by the doctor blade 15, so that the remainder corresponds to that portion of the coating which has been applied into only the engraved portion. Further, with the rotation of the gravure roll 2, the coating is carried toward a web 16 which is continuous and is travelling in a right direction as viewed in FIG. 1, and the coating is then applied onto the web 16 at a place where the web 16 is clamped between a upper rubber roll 17 and the gravure roll 2.

In this way, according to the present embodiment, even with a coating which presents a gel form under a normal condition, the rotation of the stirring and feeding roll 9 immersed in the coating within the reservoir 5 enables the fluidity of such coating to be increased utilizing a thixotropy possessed by the coating, thereby transforming the coating into the applyable form capable of being satisfactorily deposited onto the gravure roll 2, and moreover, placing the coating under a pressurized condition enables the uniform deposition thereof on the entire gravure roll 2, leading to a uniform application of the coating onto the web 16, providing a high grade of the application finish. In addition, even if the coating is substantially not overflowed from the coating container 1, an appropriate amount of the coating can be deposited onto the gravure roll 2. This eliminates a necessity for the troublesome adjustment of the viscosity as in the prior art.

It is, of course, possible in the present embodiment to uniformly apply even a coating classified into a normal Newtonian fluid onto the gravure roll 2. Particularly, a coating of components which are to be uniformly mixed is reliably and uniformly stirred and mixed at all times by the stirring and feeding roll 9 and hence, it is uniformly applied to the gravure roll 2 in an extremely good condition and then to the web 16. Alternatively, the stirring and feeding roll 9 may be rotated in the same direction as the gravure roll 2. It is preferable that the ratio in circumferential speed between the stirring and feeding roll 9 and the gravure roll 2 is changed into an appropriate value, depending upon the natures of the coatings.

Figure 3:
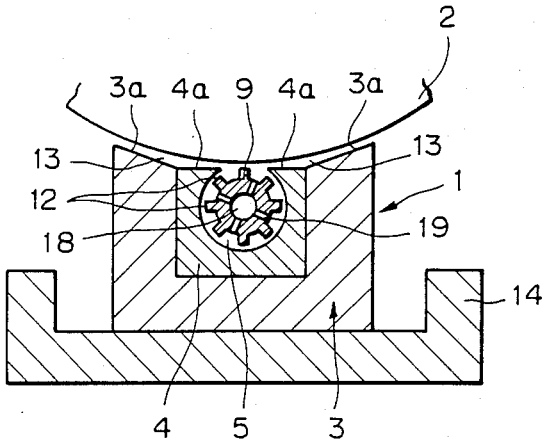
FIG. 3 is a sectional view of details, illustrating another embodiment of the present invention.

FIG. 3 illustrates another embodiment of the present invention.

In this embodiment, a central hole 18 for feeding a coating is centrally and axially perforated in the stirring and feeding roll 9, so that the coating may be fed from the central hole 18 through a large number of radial holes 19, 19— into the reservoir 5, and the narrow passage 6, the antechamber 7 and the feed hole 8 provided in the previous embodiment have been eliminated.

In this embodiment, the coating is pumped into the central hole 18 from an axial end of the stirring and feeding roll 9 projecting out of the coating container 1 or opposite ends thereof and then from the central hole 18 through the large number of the radial holes 19, 19—into the reservoir 5 while being subjected to a rotational force provided by the rotation of the stirring and feeding roll 9. Thereafter, the coating is uniformly applied in an extremely good condition onto the outer peripheral surface of the gravure roll 2 in the same manner as in the previous embodiment.

It should be noted that although the coating container 1 has been disposed just below the gravure roll 2 in the above embodiments, the placing position therefor may be displaced in a circumferential direction of the gravure roll 2, if necessary.

In addition, the section of the reservoir 5 may be of a shape other than an approximately circular shape, for example, of an approximately square shape, and the stirring mechanism may be a structure other than the stirring and feeding roll 9, for example, an agitating blade or the like.

Figure 4:
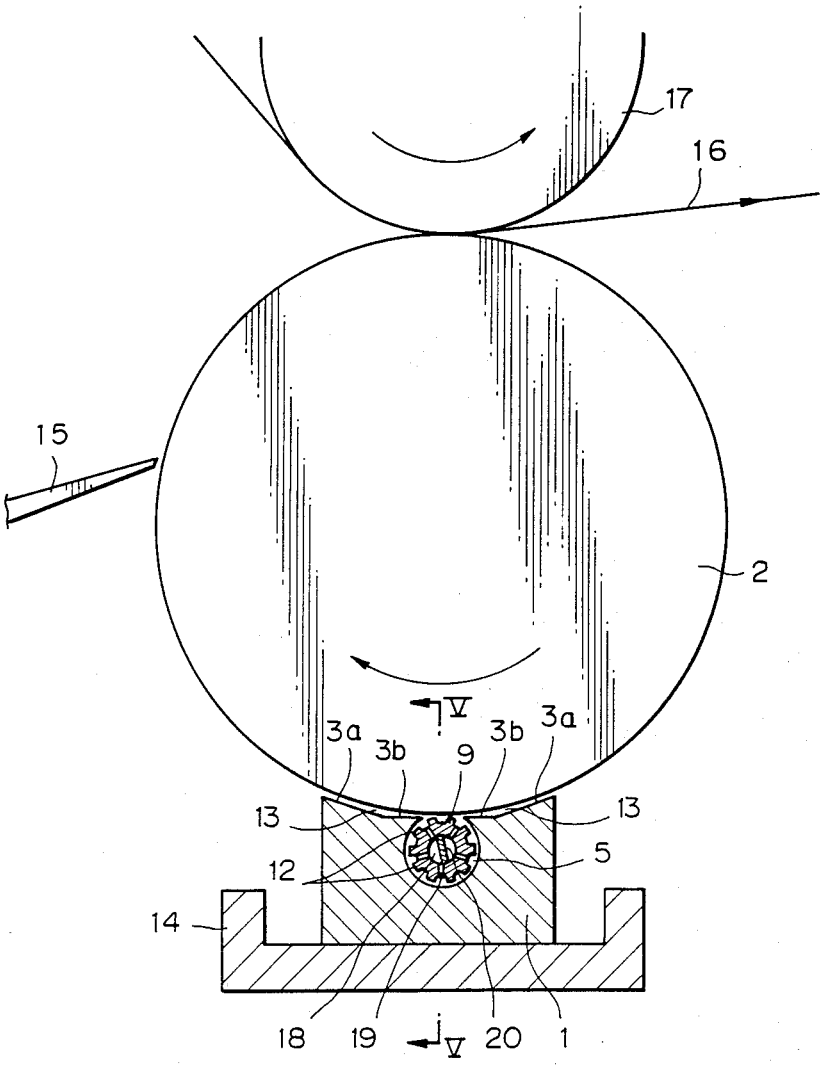
FIG. 4 is a front view in vertical section illustrating a further embodiment of the present invention.
Figure 5:
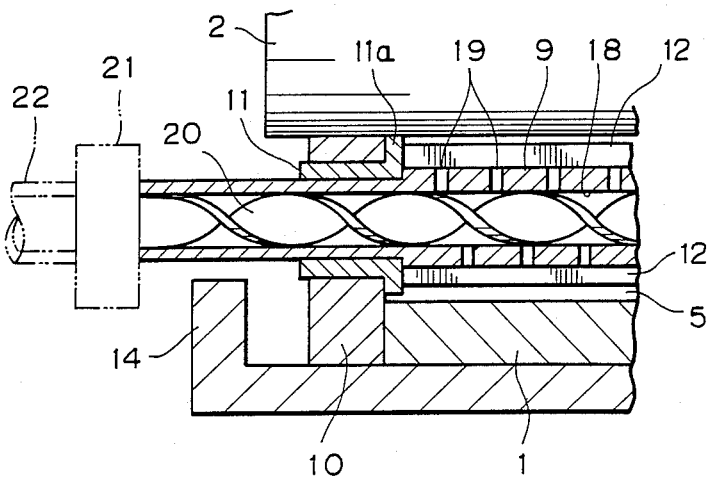
FIG. 5 is a sectional view taken along a line V—V in FIG. 4.

FIGS. 4 and 5 illustrate a further embodiment of the present invention.

This embodiment is similar to the embodiment shown in FIG. 3, except that the embodiment of FIG. 3 is further modified.

More specifically, a reservoir 5 is provided in an upper end of a coating container or vessel 1 constructed from the integral formation of the first and second bodies 3 and 4 shown in FIG. 3. Rotatably incorporated in the reservoir 5 is a stirring and feeding roll 9 which has forcedly stirring means 12 formed on its outer peripheral surface in the same manner as in FIG. 3 and which has a central hole 18 and a plurality of radial holes 19 made therein respectively at the inner and outer portions thereof. Further, in this embodiment, releasably inserted in the central axial hole 18 is a screw plate 10 which is one type of a pump mechanism rotated together with the stirring and feeding roll 9 to fulfil a pumping function. A coating feed pipe 22 is connected through a suitable coupling 21 to an outer end of the stirring and feeding roll 9, and the other end of the coating feed pipe 22 is connected to a coating storage tank which is not shown. Other parts are formed as in the previous embodiment illustrated in FIG. 3.

The following is the description of the operation of this embodiment.

In this embodiment, the stirring and feeding roll 9 has a diameter approximately one tenth of that of the gravure roll 2, i.e., as small as about 20 mm. In applying a coating, the stirring and feeding roll 9 is relatively rapidly rotated in the same direction and at substantially the same circumferential speed as the gravure roll 2. When the roll 9 is rotated, the screw plate 20 is also rotated together therewith, so that a suction force and the pumping function of the screw plate 20 cause a coating within the coating storage tank (not shown) to be pumped through the coating feed pipe 22, the coupling 21, the central axial hole 18 and the radial holes 19 into the reservoir 5 while being subjected to a rotational force. In this embodiment, a coating which presents a gelled form under a normal condition, such as a magnetic coating, may be pumped. Thereafter, the coating is supplied forcedly and uniformly into the engraved portion in the gravure roll 2 in the same manner as in the previous embodiment.

As described above, the screw plate 20, which has an effect of the previous embodiment and fulfils the pumping function, is provided within the stirring and feeding roll 9 in this embodiment and hence, a special pump need not be additionally provided as in the prior art, leading to a small-sized and simplified structure. In addition, the screw plate 20 can be withdrawn out of the central axial hole 18 in the stirring and feeding roll 9 for ease of cleaning. Furthermore, the central axial hole 18 can be cleaned readily and reliably only by passing a solvent in the same manner as in the cleaning of the interior of a normal pipe.

Figure 6:
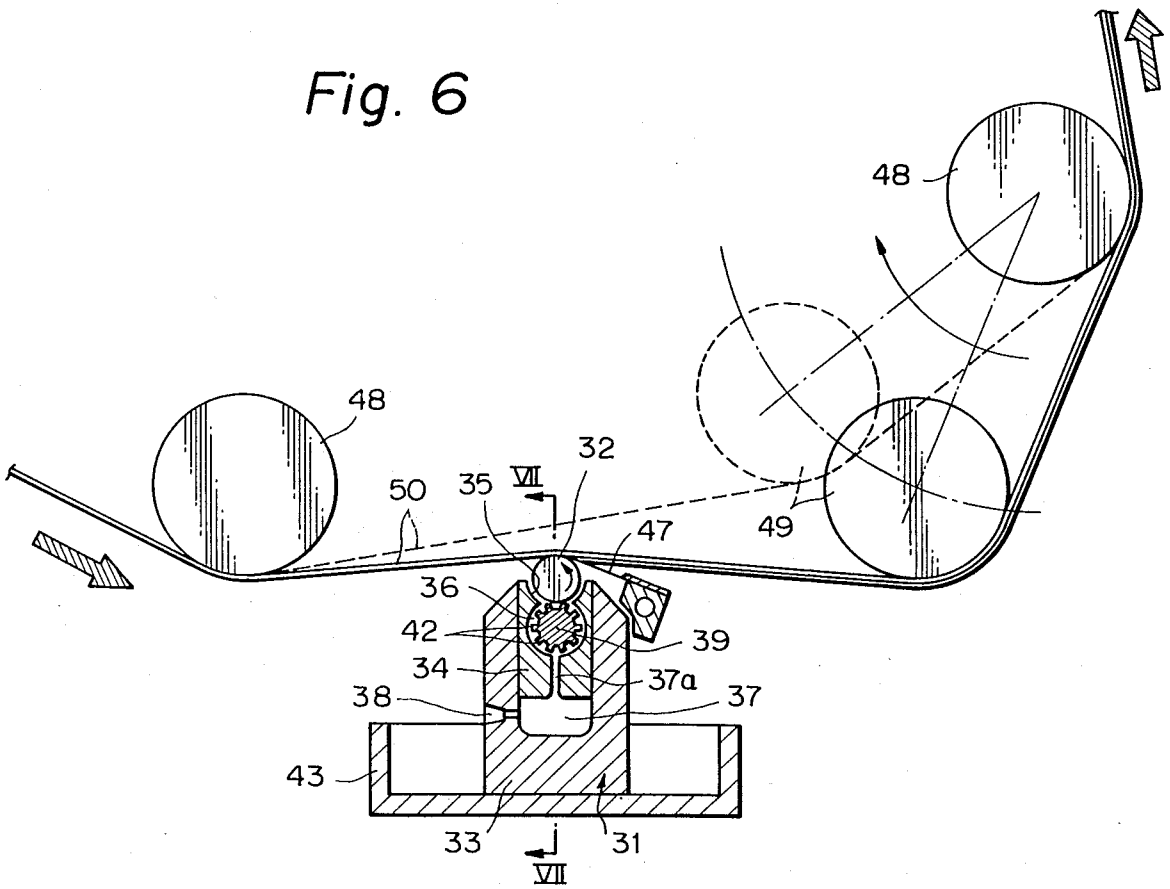
FIG. 6 is a front view in vertical section illustrating a yet further embodiment of the present invention.
Figure 7:
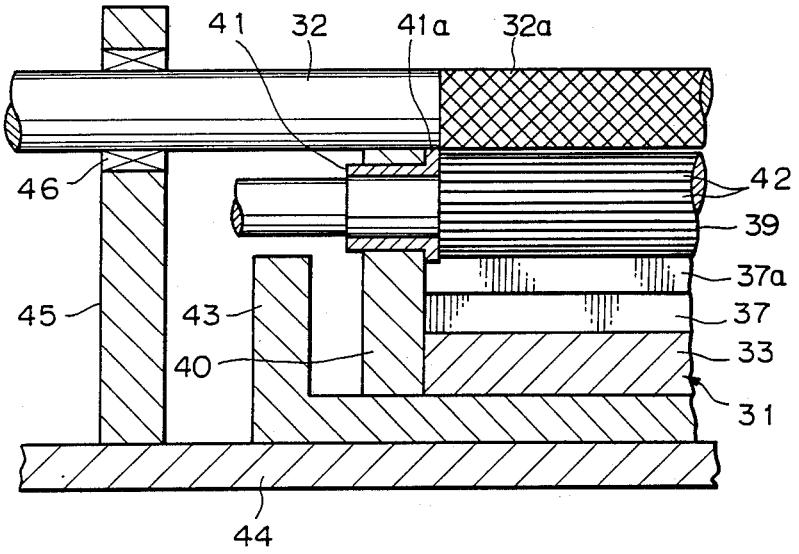
FIG. 7 is a sectional view taken along a line VII—VII in FIG. 6.

FIGS. 6 and 7 illustrate a yet further embodiment of the present invention.

In these Figures, the reference numeral 31 denotes a coating container or vessel. The coating container 31 is mounted below a gravure roll 32 having a small diameter of, for example, 20 to 40 mm, and is comprised of a first body 33 having a substantially U-shaped section, and a second body 34 secured in a recess of the first body 33 at its upper portion. The second body 34 of the coating container 31 is provided at its uppermost portion with a substantially semicircular section recess 35 in which a lower half of the gravure roll 32 is rotatably contained with a small gap. Below the recess 35, a substantially semicircular section reservoir 36 for storing a coating under a pressurized condition is defined in the second body 2 by the lower end of an outer peripheral surface of the gravure roll 32. Further, an antechamber 37 is defined between the second body 34 and the first body 33 to communicate with the reservoir 36 through a narrow passage 37*a*. The coating is passed through a feed hole 38 perforated in the lower portion of the first body 33 into the antechamber 37. A stirring and feeding roll 39, serving as one of a stirring mechanism for stirring the coating which is under a pressurized condition, is rotatably suspended transversely within the reservoir 36. More specifically, the stirring and feeding roll 39 is shown only at its one end in FIG. 7, and is rotatably supported at its opposite ends on closing walls 40 with solid sleeve bearings 41 interposed therebetween. Further, the one end of the roll 39 is passed through the closing wall 40 in a liquid tight manner to extend outwardly of the reservoir 36 and connected to suitable drive means. The stirring and feeding roll 39 is positioned with the upper portion (the uppermost end in the present embodiment) of the outer peripheral surface thereof being close to the lower portion (the lowermost end in the present invention) of the outer peripheral surface of the gravure roll 32, so that the coating may be forcedly supplied to an engraved portion 32*a* formed on the gravure roll 32. The stirring and feeding roll 39, when rotated, stirs the coating stored in the reservoir 36 under a pressurized condition, and depending upon the natures of the coatings, the outer peripheral surface of the stirring and feeding roll 39 may be flat, or may be formed with forcedly stirring means 42 shaped into a serration as in the present embodiment, if they are capable of stirring the coating. The forcedly stirring means 42 may be formed by forming the outer peripheral surface of the stirring and feeding roll 39 into a rugged shape, depending the natures of the coatings. An effective rugged shape may be selected, for example, from the above serration, a gear shape, a threaded shape having small pitches and the like. In this embodiment, a slight gap is provided between the outer peripheral surfaces of the gravure roll 32 and the stirring and feeding roll 39, so that the gravure roll 32 may be smoothly rotated, and a coating may be reliably and uniformly supplied to the engraved portion 32*a* of the gravure roll 32. The slight gap is adjusted by bringing flanges 41*a* of the solid sleeve bearings 41 exposed from the outer peripheral surface of the stirring and feeding roll 39 over the same length as the slight gap into sliding contact with the outer peripheral surface of the gravure roll 32. The coating container 31 is mounted within an overflow receptacle 43 for receiving the overflowed coating. As shown in FIG. 7, the engraved portion 32*a* is formed on the outer peripheral surface of the gravure roll 32 between both the closing walls 40 each of which also provides an effect of restriction for width in application of the coating. The gravure roll 32 is passed through a pair of support members 45 rising on a base 44 on which the overflow receptacle 43 is placed, and the gravure roll 32 is rotatably supported transversely through suitable bearings 46 and connected at one end thereof to a drive mechanism in the same way as the stirring and feeding roll 39. A doctor blade 47 is mounted for scraping an excessive amount of the coating from the engraved portion 32*a* formed on the outer peripheral surface of the gravure roll 32. In this embodiment, the coating container 31, the gravure roll 32, the stirring end feeding roll 32 and the doctor blade 47 are vertically movable in unison and together with the base 44. The gravure roll 32 is disposed for movement into the out of contact with a lower surface of a web 50 which travels in a direction indicated by an arrow in FIG. 6 along stationary guide rollers 48 and a movable guide roller 49 and which has an upper surface in a free condition.

Description will now be made of the operation of this embodiment.

First, the movable guide roller 49 is moved to a position indicated by a broken line in FIG. 1, so that the web 50 is spaced away from the gravure roll 32.

In this embodiment, the stirring and feeding roll 39 has a diameter equal to that of the gravure roll 32 and hence, in coating, the stirring and feeding roll 39 is rotated in the same direction and at substantially the same circumferential speed as the gravure roll 32. In this case, the circumferential speed of each of the rolls 32 and 39 is about two times a speed of movement of the web 50. The gravure roll 32 is rotated in a reverse direction to a direction (from the left to the right as viewed in FIG. 6) of movement of the web 50. A coating, which exhibits a gel form under a normal condition, such as a magnetic coating, is pumped by a pump or the like through the feed hole 38, the antechamber 37 and the narrow passage 37*a* into the reservoir 36 of the coating container 31 in which the stirring and feeding roll 39 is being rotated. Then, the coating is stored under a pressurized condition in the reservoir 36 and thereby spreaded uniformly throughout the reservoir 36, so that it may be applied onto the gravure roll 32 in an axially uniform manner. In this case, the coating stored under the pressurized condition in the reservoir 36 is stirred by the rapid rotation of the stirring and feeding roll 39. Particularly, because the forcedly stirring means 42 shaped in the serration is provided on the outer periphery of the stirring and feeding roll 39 in the present embodiment, the coating within the reservoir 36 is reliably stirred. Because this coating has a thixotropic nature that it is transformed from a gel to a fluid sol when stirred, it is converted into an applyable form to be deposited on the gravure roll 32, as is the case with a coating having an increased fluidity and classified into a Newtonian fluid. The coating converted into the applyable form in this way is forcedly and uniformly supplied into the engraved portion 32*a* of the gravure roll 32 upon reception of a pressing force due to its own pressurized condition and by a component of rotational force of the stirring and feeding roll 39. Then, the coating deposited uniformly on the outer peripheral surface of the gravure roll 32 is carried out of the reservoir 36 through the recess 35 toward a doctor blade 47, as the gravure roll 32 is rotated.

The coating deposited uniformly on the outer peripheral surface of the gravure roll 32 is carried upwardly with the rotation of the gravure roll 32 and scraped down by the doctor blade 47, so that the remainder corresponds to that portion of the coating which has been applied into only the engraved portion 32*a*.

When such condition is attained, the movable guide roller 49 is moved back to a position indicated by a solid line in FIG. 6 to bring the lower surface of the travelling web 50 into contact with the gravure roll 32, so that the coating uniformly applied on the gravure roll 32 is properly applied onto the lower surface of the movable guide roll 49.

In this way, according to the present embodiment, even with a coating which presents a gel form under a normal condition, the rotation of the stirring and feeding roll 39 immersed in the coating within the reservoir 36 enables the fluidity of such coating to be increased utilizing a thixotropy possessed by the coating, thereby transforming the coating into the applyable form capable of being satisfactorily deposited onto the gravure roll 32, and moreover, placing the coating under a pressurized condition enables the uniform deposition thereof on the entire gravure roll 32, leading to a uniform application of the coating onto the web 50, providing a high grade of the application finish. In addition, even if the coating is substantially not overflowed from the coating container 31, an appropriate amount of the coating can be deposited onto the gravure roll 32. This eliminates a necessity for the troublesome adjustment of the viscosity as in the prior art. Further, in this embodiment, since the coating is applied on the lower surface of the web 50 at a place where the upper surface of the web 50 is free, such application can be achieved without generation of vertical wrinkles even if the web 50 is thin. Additionally, the unit shown in FIG. 6 can be provided for each of a plurality of colors, so that a multi-color application can be conducted in an extremely ready manner by moving the whole unit to and away from the web 50 to bring the gravure roll 32 for each color into and out of contact with the lower surface of the web 50.

Figure 8:
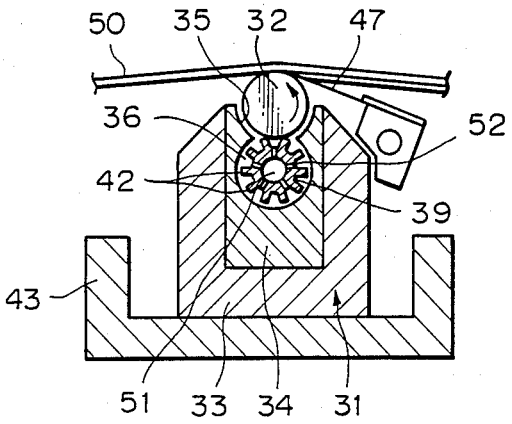
FIGS. 8 and 9 are sectional views of details, illustrating a still further embodiment of the present invention, respectively.

FIG. 8 illustrates a still further embodiment of the present invention.

In this embodiment, a central hole 51 for feeding a coating is centrally and axially perforated in the stirring and feeding roll 39, so that the coating may be fed from the central hole 51 through a large number of radial holes 52, 52—into the reservoir 36, and the narrow passage 37*a*, the antechamber 37 and the feed hole 38 provided in the previous embodiment have been eliminated.

In this embodiment, the coating is pumped into the central hole 51 from an axial end of the stirring and feeding roll 39 projecting out of the coating container 31 or from opposite ends thereof and then from the central hole 51 through the large number of the radial holes 52, 52—into the reservoir 36 while being subjected to a rotational force provided by the rotation of the stirring and feeding roll 39. Thereafter, the coating is uniformly applied in an extremely good condition onto the outer peripheral surface of the gravure roll 32 in the same manner as in the previous embodiment.

Figure 9:
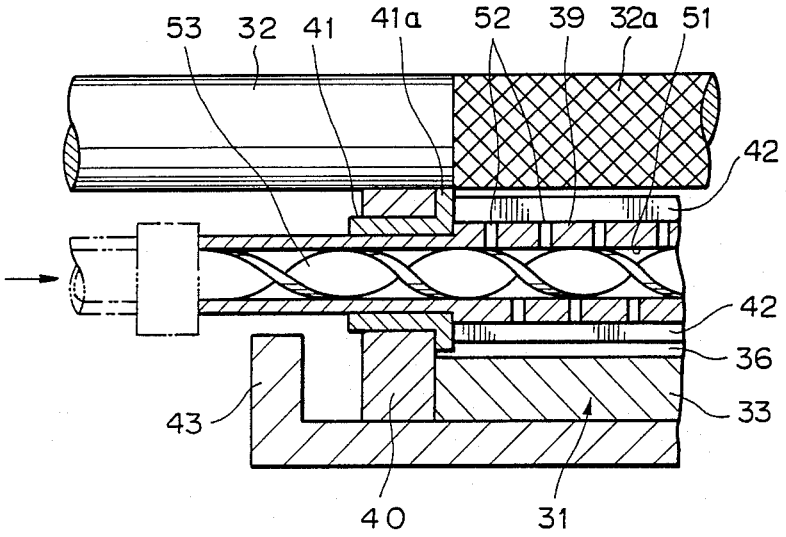

Alternatively, as shown in FIG. 9, a screw plate 53, which is one type of a pump mechanism fulfilling a pumping function, may be releasably mounted within the central hole 51 in the stirring and feeding roll 39 for rotation in unison with the stirring and feeding roll 39, so that a coating feed pump independently mounted outside in the prior art can be eliminated, and the cleaning of the whole applying system can be facilitated.

In addition, the section of the reservoir 36 may be of a shape other than a substantially circular shape, such as a substantially square shape, and the stirring mechanism may be also a structure other than the stirring and feeding roll 39, such as a agitating blade or the like.

Moreover, the present invention is not limited to the above-described embodiments, and modifications can be made as necessary.

What is claimed is:

1. A coating feeder system comprising, in close vicinity to an under portion of an outer peripheral surface of a gravure roll, a coating container or vessel defining a reservoir for storing a coating under a pressurized condition, a stirring mechanism for stirring the coating within said reservoir and a very small pressure chamber defined in the downstream from said reservoir in the rotational direction of said gravure roll and keeping the coating carried out of said reservoir under a pressurized condition for depositing the coating further axially uniformly on said gravure roll.

2. A coating feeder system according to claim 1, wherein said stirring mechanism comprises a stirring and feeding roll mounted within said reservoir.

3. A coating feeder system according to claim 2, wherein said stirring and feeding roll includes forcedly stirring means formed on an outer peripheral surface thereof for forcedly stirring the coating.

4. A coating feeder system comprising, in close vicinity to an under portion of an outer peripheral surface of a gravure roll, a coating container or vessel defining a reservoir for storing a coating under a pressurized condition, a stirring and feeding roll rotatably mounted within said reservoir for stirring the coating within said reservoir a coating feed passage which permits feeding of the coating through a central axial hole and a large number of radial holes in said stirring and feeding roll into the reservoir, a pumping mechanism and a very small pressure chamber defined in the downstream from said reservoir in the rotational direction of said gravure roll and keeping the coating carried out of said reservoir under a pressurized condition for depositing the coating further axially uniformly on said gravure roll.

5. A coating feeder system according to claim 4, wherein said stirring and feeding roll includes forcedly stirring means formed on an outer peripheral surface thereof for forcedly stirring the coating.

6. A coating feeder system comprising, in close vicinity to an under portion of an outer peripheral surface of a gravure roll having a small diameter of 20 to 40 mm and adapted to provide the application of a coating on a lower surface as a continuous traveling web at a place in which an upper surface of the web is free, a coating container or vessel defining a reservoir for storing under a pressurized condition, a stirring mechanism for stirring the coating within said reservoir and a very small pressure chamber defined in the downstream from said reservoir in the rotational direction of said gravure roll and keeping the coating carried out of said reservoir under a pressurized condition for depositing the coating further axially uniformly on said gravure roll.

7. A coating feeder system according to claim 6, wherein said stirring mechanism comprises a stirring and feeding roll mounted within said reservoir.

8. A coating feeder system according to claim 7, wherein said stirring and feeding roll includes forcedly stirring means formed on an outer peripheral surface thereof for forcedly stirring the coating.

* * * * *